US006692844B2

(12) United States Patent
Sanders et al.

(10) Patent No.: US 6,692,844 B2
(45) Date of Patent: Feb. 17, 2004

(54) GLAZE FOR CERAMIC SUPERPLASTIC FORMING (SPF) DIES

(75) Inventors: Daniel G. Sanders, Sumner, WA (US); Martin A. Peterson, Puyallup, WA (US); David C. Van Aken, Rolla, MO (US); D. Trent Weaver, Rolla, MO (US); F. Scott Miller, Rolla, MO (US); Jeffrey D. Smith, Rolla, MO (US)

(73) Assignee: The Boeing Company, Seattle, WA (US)

( * ) Notice: Subject to any disclaimer, the term of this patent is extended or adjusted under 35 U.S.C. 154(b) by 89 days.

(21) Appl. No.: 09/942,162

(22) Filed: Aug. 28, 2001

(65) Prior Publication Data

US 2003/0126951 A1 Jul. 10, 2003

Related U.S. Application Data

(60) Provisional application No. 60/228,671, filed on Aug. 29, 2000.

(51) Int. Cl.[7] ..... B01J 17/18; C01B 33/02

(52) U.S. Cl. ..... 428/689; 428/699; 428/701; 428/702; 428/410; 428/384; 428/386; 428/428; 427/255.13; 427/255.36; 427/452; 427/456; 76/107.1

(58) Field of Search ..... 428/410, 384, 428/386, 428, 689, 699, 701, 702; 76/107.1; 427/452, 456, 255.13, 255.36

(56) References Cited

U.S. PATENT DOCUMENTS

| | | | | | |
|---|---|---|---|---|---|
| 4,090,851 | A | * | 5/1978 | Berkman et al. | 117/211 |
| 4,104,442 | A | * | 8/1978 | Sussmuth | 427/377 |
| 4,287,260 | A | * | 9/1981 | Prall | 428/410 |
| 4,396,682 | A | * | 8/1983 | Mohri et al. | 114/201 R |
| 5,639,704 | A | * | 6/1997 | Inuzuka et al. | 501/119 |
| 6,235,381 | B1 | * | 5/2001 | Sanders et al. | 156/296 |
| 6,391,437 | B1 | * | 5/2002 | Kadomura et al. | 428/307.3 |

FOREIGN PATENT DOCUMENTS

| | | | | |
|---|---|---|---|---|
| JP | 63-95179 | * | 4/1988 | C04B/41/65 |

* cited by examiner

*Primary Examiner*—Deborah Jones
*Assistant Examiner*—Vivek Koppikar
(74) *Attorney, Agent, or Firm*—John C. Hammar

(57) ABSTRACT

The life of ceramic SPF dies can be enhanced significantly by plasma spray application of a cordierite glaze on the forming surface. The preferred glaze has a coefficient of thermal expansion close to or matching with the ceramic of the die, and, typically, is a 2•2•5 MAS system including 2–10 mol % $TiO_2$ (or above 8 wt %).

14 Claims, 1 Drawing Sheet

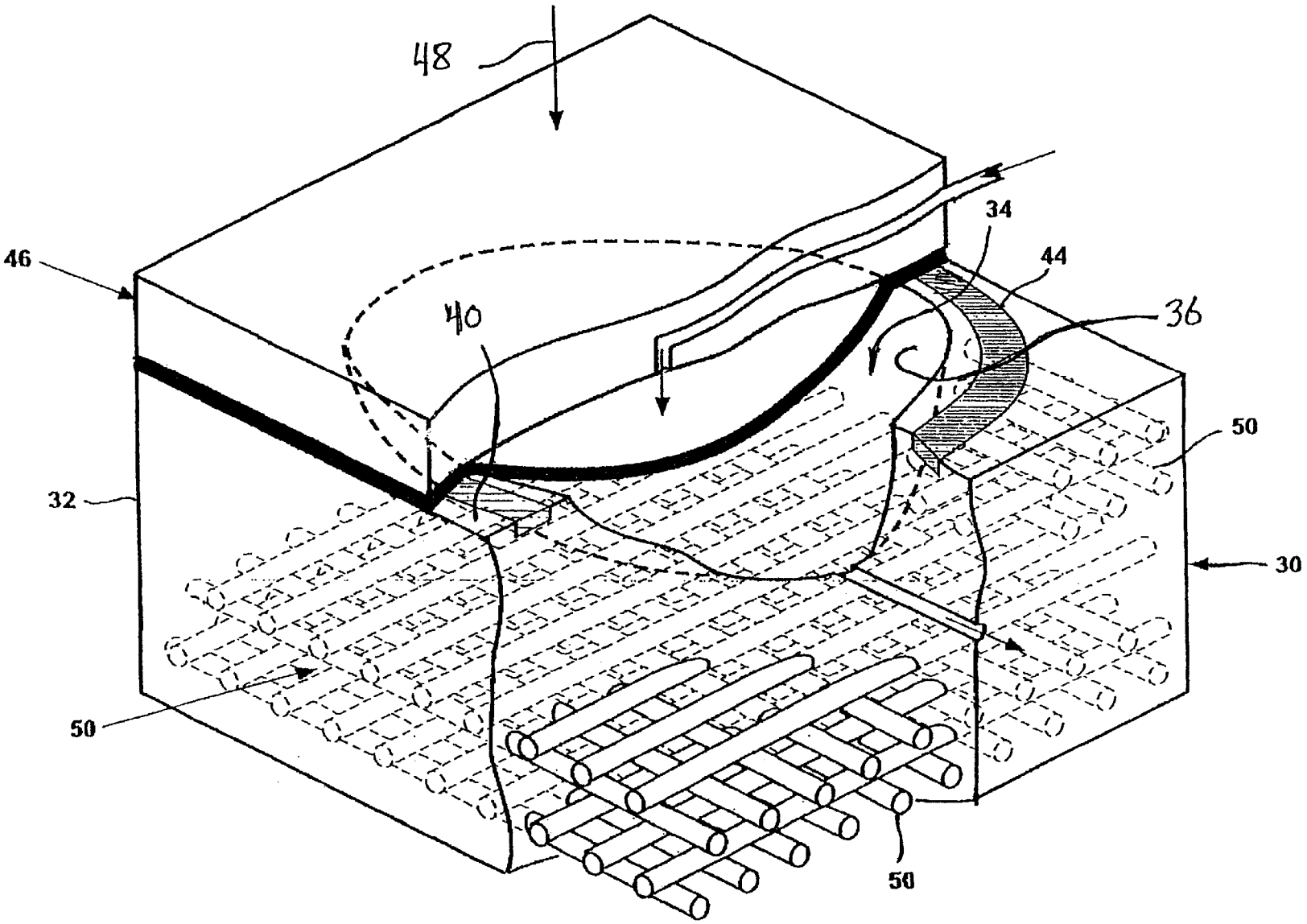
30
50
36
44
34
48
40
46
32
50
50

GLAZE FOR CERAMIC SUPERPLASTIC FORMING (SPF) DIES

REFERENCE TO RELATED APPLICATION

The present application claims the benefit of U.S. Provisional Patent Application No. 60/228,671, filed Aug. 29, 2000.

TECHNICAL FIELD

The present invention relates to a glaze for coating ceramic superplastic forming (SPF) dies to provide a hard forming surface to increase life.

BACKGROUND OF THE INVENTION

Plasma spraying is becoming more widely accepted for industrial use. The plasma spraying process consists of introducing a powder carried by a gas into a high temperature flow of ionized gas. The powder particles are subsequently melted or partially melted and propelled towards a substrate by the carrier gas. Upon impact with the target surface, the molten particles form lamellae or splats that adhere to the substrate by mechanical bonding to surface imperfections. Many metal, ceramic, and polymer powders are commercially available for plasma spraying and other thermal spray processes. Commercial powders are often spherical or semi-spherical in shape and within a specific size range, primarily to allow for good flowability or feeding characteristics. Plasma spraying can deposit a wide range of materials onto a wide range of substrates. Nearly any material that can be produced in powder form can be deposited by plasma spraying.

Plasma spray coatings made from zircon ($ZrSiO_4$) produced either tetragonal or monoclinic zirconia ($ZrO_2$) or amorphous silica ($SiO_2$). The tetragonal coating particles must have been heated above about 1200° C. while the monoclinic particles never reached 1200° C.

Water-stabilized plasma (WSP) spraying of angular garnet (crystalline) and basalt (amorphous) powders in the range of 56 to 200 $\mu$m found that the sprayed materials were well spherodized, lower in silicon and alkali content, and in the amorphous state. The extraordinarily high temperatures (>10,000° K) reached in such a plasma probably allowed for melting and spheroidization of the powders while volatilizing some constituents. The amorphicity of the coatings was likely influenced by the rapid solidification of the splats, estimated to be on the order of 10 $\mu$s. Most coatings were found to have extremely low spherical or pseudospherical porosity, which ranged from 4.6% to less than 2%, which indicated that the glassy state of the impacting particles allowed for high flowability. The residence time of the powders in the plasma was the dominant factor with respect to coating quality while the spraying distance was determined to be of much less consequence.

Another study focused on the adhesion of plasma sprayed borosilicate glass as a function of the substrate (steel) preheat temperature. Coating thicknesses of 200 to 800 $\mu$m with approximately 5% porosity were obtained by feeding extremely angular powder. Substrate preheat temperatures ranged from 50° C. to 700° C. The plasma plume was scanned across the substrate surface prior to introducing powder into the system. The coating adhesive strength increased with substrate preheating up to $T_g$ of the glass.

The substrate temperature greatly influenced the adhesion of such coatings by allowing the molten glass particles to remain less viscous for a longer time. From analysis of coating morphologies, the lamellae were better able to completely fill surface anomalies and to bond better mechanically to the substrate. Assuming that the lamellae have a much greater diameter than thickness, a one-dimensional heat conduction model for the coating is described by:

$$k/(\rho \cdot C_p) \cdot \partial^2 T/\partial x^2 = \partial T/\partial t \quad (1)$$

where T is the coating temperature at a distance x from the substrate at a time t and k, p, and $C_p$ are the thermal conductivity, density, and specific heat of the droplet. The presumption that preheating the substrate yields increased adhesion is strengthened by finding that greater deposition efficiency, or splat retention, was also obtained. Not only does substrate preheating allow for better glass flow over the substrate surface, but lower thermal gradients and tensile stresses arise across the thickness of the cooling splats.

A simplistic account of the maximum stress, $\sigma_c$, that arises in such a coating is depicted by the relationship:

$$\sigma_c) = \alpha_c \cdot (T_g - T_b) \cdot E_c \quad (2)$$

where $\alpha_c$, $T_g$, and $E_c$ are the coefficient of expansion, glass transformation temperature, and elastic modules of the glass, respectively, and $T_b$ is the substrate preheat temperature.

Rare-earth alumino-silicates, yttria-alumino-silicates, and the addition of lanthanides to more common glass systems have also been studied. Yttrium is not a rare-earth, but closely emulates true rare-earths when included in alumino-silicates. Rare-earth alumino-silicate glasses are of both scientific and industrial interest due to their relatively high $T_g$, high refractive indices ($n_d$), high hardness, high elastic moduli, chemical durability, and moderate thermal expansion.

Rare-earth ions do not play a primary role in glass formation, but significantly modify the properties of traditional glasses. Lanthanum additions (as the oxide) to sodium silicate glasses account for increased $T_g$, $n_d$, and density ($\rho$) while lowering the thermal expansion and electrical conductivity. While lanthanum additions increase $T_g$ regardless of whether soda or silica is replaced, the coefficient of thermal expansion is more markedly reduced by replacement of soda. The mechanism may involve each trivalent lanthanum ion acting as a modifier by creating three non-bridging oxygens, thus explaining the increase in $T_g$. Another option assumes that lanthanum enters a 'network' site, likely octahedral rather than tetrahedral, because of its large ionic radius, and simultaneously increases the connectivity of the structure while decreasing the concentration of nonbridging oxygens.

The maximum solubility limit of rare-earth ions that can be incorporated into most rare-earth alumino-silicate glass structures increases with decreasing atomic radii and decreasing atomic number from La to Yb. This trend is a function of lanthanide contraction. In the system $xLa_2O_3$-$25Al_2O_3$-$(75-x)SiO_2$, devitrification begins between 25 and 30 mole % $La_2O_3$. All glass compositions are given in mole ratio form unless otherwise noted. Glass transformation temperature, thermal expansion, and $n_d$ have all been found to be dependent upon ionic radius (in the system $20La_2O_3$-$20Al_2O_3$-$60SiO_2$). The transformation temperature increased with decreasing ionic radius while both thermal expansion and $n_d$ decreased. These property variations apparently are at least partially the result of rare-earth ion field strength rather than ion size alone.

Although we evaluated only one glass composition ($8.25La_2O_3$-$19.25Al_2O_3$-$72.5SiO_2$), Beinarovich et al. discovered that glass formed at approximately 1290° C. in the synthetic batch, about 150° C. lower than in the traditional oxide batch. "Traditional oxide batch" refers to glasses melted from fine raw material oxides while the "synthetic batch" refers to ions suspended in solution. The synthetic batch has higher constituent dispersion and begins with amorphous components.

Karlsson conducted a three-part study on the crystallization behavior of various $La_2O_3$—$Al_2O_3$—$SiO_2$ glasses and measured some physical properties of the glassy state. The glasses of the first study melted at 1500° C. and were cooled slowly to room temperature, after which large, white crystals were observed within the glass. X-ray analysis showed these crystals to be orthorhombic $La_2O_3$-$2SiO_2$ grown along the a-axis. From the X-ray patterns the lattice parameters of the devitrified phase were determined as a=13.15 Å, b=10.15 Å, and c=8.64 Å. A density of 2.58 g/cm$^3$ was calculated for this phase assuming four molecules per unit cell. Its melting temperature was observed to be 1420±10° C.

The second Karlsson study involved devitrification products of glasses slightly higher in alumina content. These glasses were heat treated at 950° C. and 1200° C. after which small, white, crystalline whiskers were observed in the glass. X-ray patterns of these crystals showed the compound to be orthorhombic $2La_2O_3$-$2Al_2O_3$-$5SiO_2$ with lattice parameters of a=15.02 Å, b=12.97 Å, and c=Å. This phase could be hexagonal-like since a/b only deviates by 3.5% from 2√3/3. A melting point of 1280±10° C. was determined by high-temperature microscopy. Again assuming four molecules per unit cell, a density of 4.46 g/cm$^3$ was calculated. The $2La_2O_3$-$2Al_2O_3$-$5SiO_2$ phase devitrified from some glasses and melted incongruently. Some glasses produced $La_2O_3$-$2SiO_2$ while others yielded β-alumina and $La_2O_3$-$7SiO_2$. Karlsson did not find $La_2O_3$-$11SiO_2$, but its reported formation conforms well to the devitrification scheme. Glasses along the peritectic line to the left and below the peritectic point were found to produce the $2La_2O_3$-$2Al_2O_3$-$5SiO_2$, and $La_2O_3$-$2SiO_2$ phases along with minute hexagonal crystals with a +7.76 Å and c=11.28 Å. A composition of $La_2O_3$-$3SiO_2$ was suggested for these crystals which melted at 1400±10° C.

The third Karlsson study involved physical property determinations of the glasses listed in Table 1. These glasses were melted at 1550° C. and annealed at 800° C. Additions of $La_2O_3$ to all of the glasses slightly increased their CTE with the CTE doubling at the $2La_2O_3$-$2Al_2O_3$-$5SiO_2$ composition.

TABLE 1

Compositions of glasses investigated

| No. | $La_2O_3$ wt % | $Al_2O_3$ wt % | $SiO_3$ wt % | $Nd_2O_3$ wt % |
|---|---|---|---|---|
| 1 | 38.5 | 28.5 | 33.0 | — |
| 2 | 40.0 | 15.0 | 45.0 | — |
| 3 | 35.0 | 30.0 | 35.0 | — |
| 4 | 51.0 | 22.5 | 26.5 | — |
| 5 | — | 28.5 | 33.0 | 38.5 |

Table 2 provides some physical properties for these glasses.

TABLE 2

Selected physical properties for glasses in Table 1

| Glass No. | Density g cm$^{-3}$ | Coefficient of expansion, ° C.$^{-4}$ | Refractive index | $T_{g9}$ ° C. | Temperature at which log η = 10 ° C. | log η = 6 ° C. | log η = 4 ° C. |
|---|---|---|---|---|---|---|---|
| 1 | 3.46 | $37 \cdot 10^{-7}$ | 1.642 | 755 | 910 | 1150 | 1300 |
| 2 | 3.22 | $37 \cdot 10^{-7}$ | — | 825 | 985 | 1115 | 1240 |
| 3 | 2.81 | Too viscous to be poured | | | | | |
| 4 | 2.94 | $77 \cdot 10^{-7}$ | — | 610 | 840 | (1160) | — |
| 5 | 3.63 | — | 1.636 | — | 930 | 1170 | 1310 |

Chang et al. studied effects of numerous nucleating agents on devitrification of $18La_2O_3$-$24Al_2O_3$-$58SiO_2$ glass. Various oxide and fluoride additions were made to this glass to instigate crystallization after heat treatment between $T_g$ and the onset of crystallization $T_d$. This glass was extremely difficult to crystallize. Devitrified phases were binary or ternary phases containing the nucleant additions. Upon devitrification the coefficients of thermal expansion decreased, often by more than half, and hardness increased by approximately 10%.

Replacement of $SiO_2$ by additions of $SnO_2$ in excess of 4 mole % and $P_2O_5$ in excess of 2 mole % caused devitrification in the host glass. Yttria additions stabilized the vitreous state regardless of the presence of other nucleant additions. When 4 mole % CaO displaced $SiO_2$ in conjunction with 12 mole % $TiO_2$, $ZrO_2$, or $P_2O_5$ displacement of $La_2O_3$, devitrification occurred with the resultant crystalline phasing being anorthite ($CaAl_2Si_2O_8$). Displacement of $La_2O_3$ by 6 mole % each of CaO and $CaF_2$ or 6 mole % each of BaO and $BaF_2$ yielded crystalline phase of anorthite and gehlenite in the case of calcium and celcian in the case of barium. X-ray analysis showed the fluoride additions to be more effective at inducing devitrification. Also of 4 wt % $As_2O_3$ resulted in less fragile glasses. In the case of 9 mole % each of MgO and $MgF_2$ displacement of $La_2O_3$ coupled with the addition of 1 wt % $As_2O_3$, cordierite crystallized upon heat treatment. Overall, when contrasted to those of the amorphous, the physical properties of the corresponding glass-ceramic compared as follows: density remained relatively constant, $n_d$ decreased slightly, hardness increased significantly, and thermal expansion decreased by approximately half.

Tables 3 and 4 show properties of lanthanum-aluminosilicate glasses.

TABLE 3

Selected physical properties of lanthanum-alumino-silicate glasses and glass-ceramics containing Mo and $MF_2$, where M = Ca, Ba, and Mg

| | $58SiO_2$-$24Al_2O_3$-$6La_2O_3$ $6CaO.6CaF_2$ | | $58SiO_2$-$24Al_2O_3$-$6La_2O_3$ $6BaO.6BaF_2$ | | $58SiO_2$-$24Al_2O_3$-$4La_2O_3$ $6MgO.6MgF_2$ | | $58SiO_2$-$8Al_2O_3$-$16B_2O_3$ $6Lca_2O_3.6BaO.6BF_2$ | |
|---|---|---|---|---|---|---|---|---|
| Composition | glass | glass-ceram | glass | glass-ceram | glass | glass-ceram | glass | glass-ceram |
| Density ($g/cm^3$) | 3.082 | 3.090 | 3.321 | 3.329 | 2.955 | 2.856 | 3.155 | surface crystallization only |
| refractive index | 1.597 | 1.597 | 1.597 | 1.566 | 1.566 | 1.566 | 1.578 | |
| hardness DPH ($kg/cm^2$) | 659 | 682 | 599 | 670 | 682 | 731 | 550 | |
| $\alpha_1(\times10^{-7})$* (150–300° C.) | 53.1 | 20.3 | 71.6 | 20.4 | 49.7 | 22.4 | 68.8 | |
| $\alpha_2(\times10^{-7})$* (300–450° C.) | 59.0 | 25.2 | 73.8 | 27.7 | 54.2 | 28.6 | 81.3 | |
| dilatometric | | | | | | | | |
| $T_g$ (° C.) | 767 | 700 | 755 | | 742 | 715 | 672 | |
| $A_f$ (° C.) | 803 | 819 | 807 | | 782 | 924 | 741 | |
| DTA | | | | | | | | |
| $T_g$ (° C.) | 810 | | 805 | | 800 | | 725 | |
| $A_f$ (° C.) | 885 | | 905 | | 900 | | 840 | |
| $T_g^1$ (° C.) | 1,020 | | 980 | | 975 | | 900 | |

*$\alpha_1$ and $\alpha_2$ are coefficients of thermal expansion (CTE)

TABLE 4

Selected properties of lanthanum-alumino-silicate glasses and glass-ceramics containing CaO and $NF_2$, where N = Ba and Mg

| Composition | $58SiO_2,24Al_2O_3,6La_2O_3,6CaO,6NF_2$ | | | | $58SiO_2,24Al_2O_3,4La_2O_3,9CaO,9NF_2$ | | | |
|---|---|---|---|---|---|---|---|---|
| N | Ba | | Mg | | Ba | | Mg | |
| heat-treatment | before | after | before | after | before | after | before | after |
| density | 3.183 | 3.191 | 3.100 | 3.149 | 3.219 | 3.221 | 3.155 | 3.190 |
| refractive index | 1.596 | 1.569 | 1.597 | 1.568 | 1.595 | 1.564 | 1.545 | 1.560 |
| hardness DPH | 810 | 690 | 649 | 678 | 607 | 688 | 700 | 726 |
| $\alpha_1$(150–300° C.) | 43.5 | | 66.4 | | 80.9 | 20.0 | 46.5 | 35.7 |
| $\alpha_2$(300–450° C.) | 50.2 | | 71.0 | | 97.5 | 39.0 | 56.7 | 45.7 |
| $T_g$ (dilatometric) | 700 | | 686 | | 755 | | 709 | |
| $A_f$ (dilatometric) | 805 | | 782 | | 793 | | 745 | |
| $T_g$ (DTA) | 800 | | 842 | | 805 | | 760 | |
| $A_f$ (DTA) | 930 | | 942 | | 900 | | 905 | |
| $T_c^1$ (DTA) | 980 | | 1,000 | | 925 | | 970 | |
| XRD peak | | 770 | | 1,290 | | 800 | | 730 |

Watanabe and Giess studied the devitrification behavior of stoichiometric $2MgO$-$2Al_2O_3$-$5SiO_2$ (2:2:5). They determined $T_g$, $T_d$, and $T_c$ of this composition to be approximately 765° C., 945° C., and 985° C., respectively. The CTE of this 2:2:5 glass composition was $20\times10^{-7}$/° C.

Herman et al. sprayed fused, cast, and comminuted 2:2:5 cordierite powder onto a steel substrate. The subsequent coating was found to be amorphous by X-ray diffraction, likely because of high cooling rates (~$10^{6}$° C./s) and the presence of silica. DTA analysis of the crushed coating revealed a transition to metastable $\mu$-cordierite, or quartz solid solution, at approximately 840° C. and a further transition to high-cordierite at approximately 1060° C.

A second Herman study involved thermally-induced spalling of plasma sprayed 2:2:5 cordierite, spinel ($MgO$—$Al_2O_3$) and forsterite ($2MgO$—$SiO_2$) onto an 80Ni-20Cr bond coat on a steel substrate. Coefficients of thermal expansion for five materials were determined to be $16.7\times10^{-7}$/° C., $76.8\times10^{-7}$/° C., $110\times10^{-7}$/° C., $147\times10^{-7}$/° C., and $135\times10^{-7}$/° C., respectively. The three-layerd specimens, including the substrate, were then heated by a flame impinging on the surface of the top coating followed by compressed air cooling, resulting in an average rate of temperature change equal to 4.3° C./min. The maximum coating temperature reached during the heating stage was approximately 1025±45° C. Thermal stress within the coatings was estimated by the relationship:

$$\sigma_1=E\cdot\Delta\alpha\cdot\Delta T\cdot(V_2+V_3)/(1-\mu) \quad (3)$$

where E is the elastic modululs of the system, $\Delta\alpha$ is the thermal expansion mismatch, $\Delta T$ is the rate of change in temperature, $V_2$ and $V_3$ are the volume fractions of the bond coat and substrate, and $\mu$ is Poisson's ratio. If strain is uniform throughout the coating-bond coat-substrate system, then E can be calculated by:

$$E=E_1\cdot V_1+E_2\cdot V_2+E_3\cdot V_3 \quad (4)$$

where subscripts 1, 2, and 3 represent the top coat, bond coat, and substrate, respectively. Because of increased thermal stresses with greater CTE mismatch, the cordierite was first to spall followed by spinel, then forsterite.

Tables 5, 6a, and 6b show properties of 21 different lanthanum-alumino-silicate glass-ceramics.

TABLE 5

Compilation of lanthanum-alumino-silicate glass and glass-ceramic compositions

| Glass Number | composition: Mole pct $La_1O_3$ | Mole pct $Al_2O_3$ | Mole pct $SiO_2$ | Mole pct MgO | Mole pct $B_2O_3$ | Mole pct BaO |
|---|---|---|---|---|---|---|
| 1 | 7.32 | 20.96 | 66.69 | — | 4.73 | 0.29 |
| $2_a$ | 7.19 | 15.28 | 69.63 | 1.07 | 6.80 | — |
| 3 | 8.00 | 13.63 | 72.29 | 2.59 | 3.49 | — |
| $4_b$ | 6.53 | 14.46 | 70.21 | 5.25 | 2.68 | — |
| 5 | 6.71 | 10.04 | 70.31 | — | 2.51 | 1.43 |
| 6 | 12.48 | 29.52 | 58.00 | — | — | — |
| 7 | 12.05 | 14.44 | 73.51 | — | — | — |
| 8 | 10.92 | 29.90 | 59.19 | — | — | — |
| 9 | 10.13 | 26.97 | 53.90 | — | — | — |
| $10_c$ | — | 29.64 | 58.23 | — | — | — |
| $11_d$ | 18.00 | 24.00 | 54.00 | — | — | — |
| $12_e$ | 18.00 | 24.00 | 54.00 | — | — | — |
| $13_f$ | 18.00 | 24.00 | 54.00 | — | — | — |
| $14_g$ | 6.00 | 24.00 | 58.00 | — | — | — |
| $15_h$ | 6.00 | 24.00 | 54.00 | — | — | 6.00 |
| $16_i$ | 4.00 | 24.00 | 54.00 | 9.00 | — | — |

TABLE 5-continued

Compilation of lanthanum-alumino-silicate glass and glass-ceramic compositions

| Glass Number | composition: Mole pct $La_1O_3$ | Mole pct $Al_2O_3$ | Mole pct $SiO_2$ | Mole pct MgO | Mole pct $B_2O_3$ | Mole pct BaO |
|---|---|---|---|---|---|---|
| $17_j$ | 6.00 | 8.00 | 58.00 | — | 16.00 | 6.00 |
| $18_k$ | 6.00 | 24.00 | 58.00 | — | — | — |
| $19_l$ | 6.00 | 24.00 | 58.00 | — | — | — |
| $20_m$ | 4.00 | 24.00 | 54.00 | — | — | — |
| $21_n$ | 4.00 | 24.00 | 54.00 | — | — | — |

$_a$= 0.03 mol % $Sb_2O_3$
$_b$= 0.87 mol % $Sb_2O_3$
$_c$= 12.13 mol % $Nd_2O_3$
$_d$= 4.00 mol % $SnO2_3$
$_e$= 4.00 mol % $TiO_3$
$_f$= 4.00 mol % $ZrO_3$
$_g$= 6.00 mol % CaO and 6.00 mol % $CaF_2$
$_h$= 6.00 mol % $BaF_2$
$_i$= 9.00 mol % $MgF_2$
$_j$= 6.00 mol % CaO
$_k$= 6.00 mol % CaO and 6.00 mol % $BaF_2$
$_l$= 6.00 mol % CaO and 6.00 mol % $MgF_2$
$_m$= 9.00 mol % CaO and 6.00 mol % $BaF_2$
$_n$= 9.00 mol % CaO and 6.00 mol % $MgF_2$ TABLE 6a Further compilation of selected physical properties of lanthanum-alumino-silicate glasses of Table 5.

| Glass No. | density ($g/cm^2$) | $n_p$ | hdns. DPH ($kg/cm_2$) | $CTE_1$ ($10^{-7}$/° C.) | $CTE_2$ ($10^{-7}$/° C.) | DTA $T_g$ (° C.) | DTA $A_f$ (° C.) | DTA $T_c1$ (° C.) |
|---|---|---|---|---|---|---|---|---|
| 1 | — | — | — | (0–300° C.) 22 | — | 828 | 904 | — |
| 2 | — | — | — | (0–300° C.) 34 | — | 760 | 868 | — |
| 3 | — | — | — | (0–300° C.) 25 | — | 886 | 930 | — |
| 4 | — | — | — | (0–300° C.) 31 | — | 808 | 880 | — |
| 5 | — | — | — | (0–300° C.) 32 | — | 832 | 880 | — |
| 6 | 3.46 | 1.642 | — | (20-$T_g$° C.) 37 | — | 755 | — | — |
| 7 | 3.22 | — | — | (20-$T_g$° C.) 41 | — | 825 | — | — |
| 8 | 2.81 | — | — | — | — | — | — | — |
| 9 | 2.94 | — | — | (20-$T_g$° C.) 77 | — | 610 | — | — |
| 10 | 3.63 | 1.636 | — | — | — | — | — | — |
| 11 | 3.895 | 1.653 | 638 | — | — | 876 | 963 | 1026 |
| 12 | 3.806 | 1.652 | 677 | — | — | 860 | 934 | 984 |
| 13 | 3.850 | 1.653 | 720 | — | — | 857 | 949 | 1007 |
| 14 | 3.082 | 1.597 | 659 | (150–300° C.) 53.1 | (300–450° C.) 59.0 | 810 | 885 | 1020 |
| 15 | 3.321 | 1.597 | 599 | (150–300° C.) 71.6 | (300–450° C.) 73.8 | 805 | 905 | 980 |
| 16 | 2.955 | 1.586 | 682 | (150–300° C.) 49.7 | (300–450° C.) 54.2 | 800 | 900 | 975 |
| 17 | 3.155 | 1.578 | 550 | (150–300° C.) 66.8 | (300–450° C.) 81.3 | 725 | 840 | 900 |
| 18 | 3.183 | 1.596 | 610 | (150–300° C.) 43.5 | (300–450° C.) 50.2 | 800 | 930 | 980 |
| 19 | 3.100 | 1.597 | 649 | (150–300° C.) 66.4 | (300–450° C.) 71.0 | 842 | 942 | 1000 |
| 20 | 3.219 | 1.595 | 607 | (150–300° C.) 80.9 | (300–450° C.) 97.5 | 805 | 900 | 925 |
| 21 | 3.155 | 1.545 | 700 | (150–300° C.) 46.5 | (300–450° C.) 56.7 | 760 | 905 | 970 |

$n_p$ = refractive index
$T_g$ = glass transition temperature
$A_f$ = softening temperature
$T_c^1$ = temperature of which crystallization occurs most rapidly TABLE 6b Further compilation of selected physical properties of lanthanum-alumino-silicate glass-ceramics of Table 5.

| Glass No. | density ($g/cm^2$) | $n_p$ | hdns. DPH ($kg/cm_2$) | $CTE_1$ ($10^{-7}/°$ C.) | $CTE_2$ ($10^{-7}/°$ C.) |
|---|---|---|---|---|---|
| 1 | — | — | — | — | — |
| 2 | — | — | — | — | — |
| 3 | — | — | — | — | — |
| 4 | — | — | — | — | — |
| 5 | — | — | — | — | — |
| 6 | — | 1.642 | — | — | — |
| 7 | — | — | — | — | — |
| 9 | — | — | — | — | — |
| 10 | — | 1.636 | — | — | — |
| 11 | — | — | — | — | — |
| 12 | — | — | — | — | — |
| 13 | — | — | — | — | — |
| 14 | 3.09 | 1.567 | 682 | (150–300° C.) 20.3 | (300–450° C.) 25.2 |
| 15 | 3.329 | 1.566 | 670 | (150–300° C.) 20.4 | (300–450° C.) 27.7 |
| 16 | 2.856 | 1.566 | 731 | (150–300° C.) 22.4 | (300–450° C.) 28.6 |
| 17 | ++ | ++ | ++ | ++ | ++ |
| 18 | 3.191 | 1.569 | 690 | — | — |
| 19 | 3.149 | 1.568 | 678 | — | — |
| 20 | 3.221 | 1.564 | 688 | (150–300° C.) 20# | (300–450° C.) 39# |
| 21 | 3.19 | 1.56 | 726 | (150–300° C.) 35.7# | (300–450° C.) 45.7# |

++ crystallization limited to surface
# after heat treatment (12 hrs. from $T_g$ to $A_t$ and held for 12 hrs. at $T_c^1$)
$n_p$ = refractive index

SUMMARY OF THE INVENTION

Two systems of primary interest for hardening the surface of ceramic SPF dies according to the present invention are the cordierite and lanthanum-alumino-silicate glasses and their related glass-ceramics. Both systems have moderate to low coefficients of thermal expansion (CTE) in both their amorphous and devitrified states, high chemical suresistance, good strength, and high glass transformation temperatures ($T_g$). These attributes make the two systems attractive as coatings for high temperature applications involving thermal cycling if paired with substrate materials of similar expansion characteristics.

Coating materials based upon cordierite ($2MgO\text{-}2Al_2O_3\text{-}5SiO_2$ or 2•2•5 MAS) with titania additions have a coefficient of thermal expansion that can be tailored by composition or thermal treatment to match each of the refractory concretes commonly used to make ceramic SPF dies. A lanthanum-alumino-silicate (LAS) system may be an alternative to the preferred 2•2•5 MAS system, but at a higher cost.

Cordierite or magnesia-alumino-silicate glass is attractive as a thermal shock resistant coating material for ceramic SPF dies because of its low thermal expansion. Hummel and Reid showed that higher alumina contents rather than magnesia were more effective in lowering thermal expansion with constant silica. Of the five compositions they studied (1360° C. eutectic, 1345° C., 1:1:4, 1:1:6, and 1:1:10), the $MgO—Al_2O_3\text{-}10SiO_2$ (1:1:10) glass had the lowest thermal expansion, $20.2\times10^{-7}/°$ C. The thermal expansion of solid solution cordierite of the same compositions were all virtually the same as that of the 1:1:10 glass.

An 8 mole % $TiO_2$ composition was initially chosen to prove that crystalline deposits could be air plasma sprayed (APS). APS is important with respect to coating the low expansion, silica based materials such as CERADYNE 220, which is preferred for the SPF dies. Surface qualities improved with preheat temperature and the coatings were crystalline when preheat temperatures exceeded 700° C. A crystalline coating of low thermal expansion indialite could also be obtained by post surface heat treatment using the plasma torch. Turning the powder feed off and passing the plasma flame over the coated surface provided sufficient heat to crystallize the coating. Coating materials were tested by decreasing the titania content to achieve a better match of the CTE with that of CERADYNE 220.

BRIEF DESCRIPTION OF THE DRAWINGS

The figure is an isometric of a typical reinforced ceramic SPF die set, partially in cutaway.

DETAILED DESCRIPTION OF A PREFERRED EMBODIMENT

The present invention includes a method for enhancing the life of a ceramic SPF die by applying a tough coating to the forming surface. The invention also pertains to the coated die. The figure illustrates the typical SPF application. While described with reference to superplastic forming (SPF), the invention is generally applicable to ceramic dies used in other high temperature applications. The invention is compatible with presses employing radiant, resistive, or induction heating.

In the figure, a ceramic SPF die set 30 includes a die base 32 and lid 46. The die base 32 includes a forming cavity 34. The glaze 36 of the present invention is applied to the forming surface defined by the forming cavity 34. In operation, the base 32 and lid 34 are pressed together with suitable press equipment to generate compressive force 48. Sealing occurs between a bead or groove on the lip 40 of the base 32 and a corresponding gasket, such as stainless steel ring 44, seated in the lid 34. The base 32 includes several rows of reinforcing quartz rods 50, as described in U.S. Pat. No. 6,235,381, which we incorporate by reference. The base 32 and lid 34 preferably are formed from castable ceramic, particularly CERADYNE THERMOSIL 220. The glaze of the present invention has a coefficient of thermal expansion (CTE) engineered to match closely the CTE of the die set.

A preferred glaze is a cordierite modified with minor additions of titania ($TiO_2$), as will be explained in greater detail.

2•2•5 MAS glass is a cordierite glass that has a low coefficient of thermal expansion and relatively high melting temperature (1450° C.). The thermal expansion characteristics of this cordierite glass-ceramic are similar to those of the castable refractory materials commonly used in ceramic SPF dies. Cordierite glass-ceramics, in general, are relatively chemically inert. Small additions of $TiO_2$ act as a nucleating agent and lower the melting temperature without the formation of a second phase. Preferably we add 2–10 mol % with the goal being the addition of sufficient $TiO_2$ to obtain essentially the same coefficient of thermal expansion (CTE) in the tough glaze overcoat and in the die.

All of our starting components were in the form of oxides; $Al_2O_3$ (99.0% pure, Alcoa Industrial Chemicals), $SiO_2$ (99.0% pure, Sigma), MgO (99.0% pure, Cerac, Inc.) and $TiO_2$ (99.0% pure, Aldrich). No carbonates or hydroxides were used, and all starting materials were research grade, −325 mesh powders. Appropriate amounts of each component were added together for each composition. The powders were intimately mixed and poured into a platinum crucible.

A platinum crucible was placed in a molydenum disilicide ($MoSi_2$) resistance furnace (Deltech, Inc.) and heated to 1635° C. for 12 hours. This allowed the components to melt and convective mixing to occur. In an initial solidification method, the platinum crucible containing the molten mixture was removed from the furnace, and the glass was cast onto room temperature (initially) steel plates and allowed to cool rapidly. A glass body formed with many cracks because of the thermal shock.

To prevent the cracking, and to facilitate later characterization of the samples, we adopted a second solidification method. The crucible was removed from the furnace and the molten glass was cast onto a preheated (150° C.–300° C.) steel sheet, which was immediately transferred to an adjacent annealing furnace, a superkanthal resistance furnace (Lindberg/Blue M), maintained at 810° C. for 6 hours. The glass was then furnace cooled to room temperature over a 12 hour period. This method resulted in glass bodies without cracks and minimum residual stresses, as determined by viewing the cooled glasses through cross polarized films and noting the absence of stress lines.

A third method assured homogeneity of the glass-ceramics, and further facilitated the preparation of the thermal expansion samples. After removing the crucible from the furnace, the glass was cast onto the steel in a ribbon, rather than a round puck. This ribbon was allowed to cool, was crushed and ground to a fine powder, and was remelted. The remelted glass was again cast into ribbons and cooled. The ribbons were easily sectioned into one inch lengths for the thermal expansion measurements, or were ground into powders for the DTA or XRD experiments.

To determine the crystallization behavior of five glass compositions (2•2•5 MAS+0, 2, 4, 6, and 8 mol % $TiO_2$), simultaneous thermal graviometric analysis and differential thermal analysis (TGA/DTA) was performed. For each composition, the glass was ground by hand in an agate ($SiO_2$) mortar and pestle until finely ground as a "flour", such that there was no grittiness when rubbed between the fingers. A 230 mg sample was weighed for each batch, and placed in an alumina crucible. Corundum was chosen as a reference because it does not undergo any type of reaction in the temperature range used here. The sample and reference crucibles were then placed in the TGA/TDA apparatus (simultaneous Thermal Analysis STA 409, Netzsch, Inc.). All the TGA/DTA results were obtained in an ambient air atmosphere. The two crucibles were heated from 36–1500° C. at a rate of 10° C./minute. The weight of the sample crucible and the output of both thermocouples were recorded as a function of temperature. The glass transition temperature, temperature of maximum crystallization of any crystalline phases or transformations, and the melting temperature of the then-ceramic material were determined from the DTA curves.

X-ray diffraction disclosed the crystalline phases present and also the amount of amorphous glass present in samples. The initial five glass compositions were analyzed to check for any crystalline phases that may have formed during annealing, and the crystallized samples were analyzed to determine which crystalline phases were present and also to determine if the sample had fully crystallized.

The samples were ground using in agate mortar and pestle to a fine, "flour-like" size. The powder was then pressed into a 22 mm diameter×2 mm deep sample holder cup that was placed horizontally in the Automated XDS 3000 Diffractometer (Scintag, Inc.). The samples were irradiated by a collimated X-ray beam utilizing a 45 kV, 40 mA X-ray tube producing Cu—Ka radiation of 1.54 Å wavelength. The diffracted intensity was detected by a solid state, lithium-drifted silicon detector cooled by liquid nitrogen to reduce noise. The diffractometer was operated over a range of 2Θ angles from 5° to 60°, at a step size of 0.03° and a dwell time of 2 seconds per step. The diffractometer was operated and data collected using Diffraction Management Software (DMS, Scintag, Inc.).

We expected the cordierite glasses to crystallize into a metastable, hexagonal, low temperature phase similar to quartz, but with the other elements in solid solution. This phase is called quartz-solid solution or $quartz_{ss}$. At higher temperatures, this phase was reported to transform to either a hexagonal phase called indialite or an orthorhombic phase called α-cordierite. To characterize the samples, the experimental powder diffraction patterns of each sample were compared to known published patterns to determine the phases present. A Reitveld analysis determined the amounts of each phase present in the samples. For the samples heat treated at high temperatures, a peak broadening analysis was performed to distinguish between the high temperature indialite and α-cordierite phases.

The thermal expansion behavior of the various compositions in both glassy and crystalline form was determined using an Orton Model 1600 D Dilatometry system. The ribbon samples were cut to one inch lengths. To study the thermal behavior of the crystalline forms, the glass sample of the appropriate composition was heat treated for 6 hours at the crystalline temperature determined by the previous DTA to form a fully crystallized glass-ceramic. These samples were placed in the alumina sample holder of the dilatometer, and heated at a rate of 5° C./minute until the sample began to deform. The expansion data was then downloaded from the dilatometry computer system, and the slope of the expansion versus temperature plot was calculated.

The TGA data from all compositions showed that the change in weight of the sample was less than 1% of its original weight. There was no volatilization of components, and no further oxidizing in the air as the samples were heated.

The DTA data recorded in Table 7 indicates the temperatures at which phase changes occurred in the glass sample upon heating.

TABLE 7

Transformation temperatures in 2·2·5 MAS with $TiO_2$ additions as determined by DTA

| $TiO_2$ Addition | $T_g$ | $T_{quartzss}$ | $T_{indialite}$ | $T_m$ |
|---|---|---|---|---|
| 0 mol % | 853° C. | 994° C. | 1083° C. | 1466° C. |
| 2 mol % | 839° C. | 949° C. | 1107° C. | 1449° C. |
| 4 mol % | 823° C. | 936° C. | 1093° C. | 1431° C. |
| 6 mol % | 822° C. | 925° C. | 1095° C. | 1414° C. |
| 8 mol % | 801° C. | 923° C. | 1178° C. | 1400° C. |

Heat treatments were devised for all the glass compositions to crystallize each to both the $quartz_{ss}$ and indialite glass-ceramics. In all cases, the glass samples were placed in a furnace heated to 850° C. for 6 hours, then heated to the temperature of maximum crystallization as shown above for 6 hours, and allowed to furnace cool. We prepared fifteen samples, five glass samples with 0, 2, 4, 6 and 8 mol % $TiO_2$; five $quartz_{ss}$ glass-ceramic samples with 0, 2, 4, 6, and 8 mol % $TiO_2$; and five indialite samples with 0, 2, 4, 6, and 8 mol % $TiO_2$. These samples were then characterized by X-ray diffraction for phase analysis and dilatometry to determine coefficients of thermal expansion for each.

The X-ray diffraction data from the glass samples indicated no crystalline phases present, confirming that the glass preparation procedures were successful in producing glass starting materials.

The results of peak broadening analysis of powder diffraction patterns of the high temperature heat treated samples indicated that the high temperature phase in all cases was that of hexagonal indialite, not orthrhombic α-cordierite.

Thermal expansion measurements were performed on all of the samples, both glass and crystalline. The results of those measurements are presented in Table 8.

TABLE 8

Coefficients of thermal expansion as determined by dilatometry

| Composition | Glass CTE(° C.) (100–800° C.) | $Quartz_{ss}$ CTE(° C.) (100–1000° C.) | Indialite CTE(° C.) (100–1000° C.) |
|---|---|---|---|
| Melted Once | | | |
| 2·2·5 MAS + 0 mol % $TiO_2$ | $43.6 \times 10^{-7}$ | $19.6 \times 10^{-7}$ | $26.2 \times 10^{-7}$ |
| 2·2·5 MAS + 2 mol % $TiO_2$ | $42.7 \times 10^{-7}$ | $9.2 \times 10^{-7}$ | $6.7 \times 10^{-7}$ |
| 2·2·5 MAS + 4 mol % $TiO_2$ | $45.4 \times 10^{-7}$ | $12.7 \times 10^{-7}$ | $12.6 \times 10^{-7}$ |
| 2·2·5 MAS + 6 mol % $TiO_2$ | $49.2 \times 10^{-7}$ | $43.1 \times 10^{-7}$ | $15.0 \times 10^{-7}$ |
| 2·2·5 MAS + 8 mol % $TiO_2$ | $42.8 \times 10^{-7}$ | $53.4 \times 10^{-7}$ | $23.3 \times 10^{-7}$ |
| Melted and Remelted | | | |
| 2·2·5 MAS + 0 mol % $TiO_2$ | $46.6 \times 10^{-7}$ | $21.3 \times 10^{-7}$ | $12.1 \times 10^{-7}$ |
| 2·2·5 MAS + 2 mol % $TiO_2$ | $51.1 \times 10^{-7}$ | | $12.7 \times 10^{-7}$ |
| 2·2·5 MAS + 4 mol % $TiO_2$ | | | |
| 2·2·5 MAS + 6 mol % $TiO_2$ | $45.1 \times 10^{-7}$ | | $26.9 \times 10^{-7}$ |
| 2·2·5 MAS + 8 mol % $TiO_2$ | $49.7 \times 10^{-7}$ | $57.8 \times 10^{-7}$ | $47.4 \times 10^{-7}$ |

The glass transition temperatures ranged from 850° C., for the glass with no nucleating agents, down to 800° C. for the glasses with 8 mol % $TiO_2$. Similarly, the melting temperatures ranged from 1466° C. to 1400° C. The glasses crystallized to an intermediate hexagonal phase, $quartz_{ss}$, in the range 994° C. to 923° C. They transformed to a hexagonal phase, $quartz_{ss}$, in the range 994° C. to 923° C., and transformed to a hexagonal phase, indialite, at temperatures in the range of 1178° C. to 1083° C. The glasses exhibited coefficients of thermal expansion in the range $40–50\times10^{-7}$/° C. over the temperature range 100–800° C. The $quartz_{ss}$ samples and indialite samples had thermal expansions that were highly dependent on the amount of $TiO_2$ addition. The lowest expansions (about $12\times10^{-7}$/° C.) occurred with $TiO_2$ additions in the range of 2–4 mol %. With additions of 8 mol % $TiO_2$, the coefficient of thermal expansion was comparable with that of the amorphous glass. Thus, with appropriate addition of $TiO_2$ and heat treatment, a cordierite material can be produced to match the CTE of the candidate refractory materials on which it is sprayed.

Experiments to determine the coefficient of thermal expansion (CTE) were performed on four different refractory concretes that were considered for use in making high temperature dies. These ceramic materials consisted of two mullite-based refractories designated as NORTON and PHLOCAST 30 and two high-silica, low expansion refractories designated as CERADYNE 220 and MORCO F-14. Each material was cast in accordance with the manufacturer's specifications and the molds were vibrated until all air bubbles had been released from the mold wall. After vibration, all castings of each material were allowed to set for 24 hours in their molds in a very high humidity environment. The coupons were then removed from the molds and further dried at 110° C. for 24 hours. Dried coupons were then placed in a SiC resistance furnace at room temperature for firing. The furnace and load temperature was increased at 3° C./min to 950° C. and held for five hours. The furnace and coupons were then cooled at 3° C./min to room temperature and the coupons were removed.

Dilatometry specimens were cut using a diamond-wafering blade to minimize damage. An Orton Model 1600 Dilatometer was used to measure the percent linear change for each refractory in a temperature range from 50 to 925° C. The temperature was limited to 925° C. to prevent the formation of cristobalite. The temperature rate of change was held constant at 5° C./min for each test. The mullite based die materials exhibited a higher CTE.

The silica-based concretes were more challenging to coat since the thermal sprayed layer should have a lower CTE than the substrate to prevent tensile residual stresses in the coating. We developed one or two coating materials, either glass or glass-ceramic, that would be suitable for CERADYNE 220. This low CTE coating material could then be adjusted to match the mullite-based concretes by adding alumina ($Al_2O_3$) to increase the CTE via co-spraying to develop a composite coating. The CTE of $\alpha$-$Al_2O_3$ is approximately $90\times10^{-7}$/° C.

2•2•5 MAS (or 2•2•5) has a sufficiently high crystalline temperature (>1050° C.) and may be stable as a glass during superplastic forming. It has a CTE of approximately $42\times10^{-7}$/° C. When crystallized, the CTE drops to $12\times10^{-7}$/° C. which should be low enough to coat CERADYNE 220 concrete to essentially achieve CTE matching. Cordierite is deposited as a glass and would require post spray processing to produce a compatible coating. Unfortunately, the devitrification of the glass results in a 4% volume contraction. To avoid the contraction, we sought to lower the crystallization temperature by the addition of a nucleation agent such as $TiO_2$ in the hopes of producing a crystalline cordierite coating during deposition.

Thermal spray experiments were conducted using $2MgO$-$2Al_2O_3$-$5SiO_2$ with 8 mol % $TiO_2$ (2•2•5–8) since this material had the lowest crystallization temperature and a CTE less than the mullite-based materials. We sought to produce the crystalline indialite structure in the as-sprayed deposit. We produced powder less than 100 $\mu$m in diameter by milling and sieving. During sieving, fines less than 38 $\mu$m were removed and powders over 106 $\mu$m were returned for further milling.

The 2•2•5–8 cordierite crystallized to the indialite crystal structure has a CTE of $27\times10^{-7}$/° C., PHILOCAST 30, with a CTE of $52\times10^{-7}$/° C., was chosen as the best substrate for our air plasma spray experiments.

A series of coupons were coated using different substrate preheats. A SiC resitance element furnace was used to preheat the coupons. The temperature was calibrated using thermocouples embedded 2.5 mm below the surface of the coupons. Coupons were quickly transported from furnace to holder for APS and spraying to begin. All coupons were sprayed for 60 to 70 seconds, then allowed to air cool on refractory brick. Once cool, the coupons were sectioned with a diamond-wafering blade and diffraction patterns were obtained from the as-sprayed surfaces. These specimens were then C-coated and employed for SEM/EDS analyses.

Air plasma spraying was conducted using a PRAXAIR SG-100 gun operating at 25 kW. Argon was used as both the powder carrier gas and the arc gas. Hydrogen was added to the arc gas to produce better heat transfer to the powders and a stand off distance of 30 mm was used. In most cases, the temperature increased 60 to 80° C. during plasma spraying. The largest increase in temperature was for the room temperature coupon.

Coatings were glassy in nature for preheats less than 600° C. Crystalline coatings were produced when preheat temperatures were at 700° C. and above. A mixture of indialite and quartz solid solution was observed for the crystalline coatings with the indialite being dominant. The coating likely experienced thermal heating on the order of the crystalline temperature for the 2•2•5–8 composition, i.e. 1178° C.

An additional benefit to preheating the substrate is an improved surface quality. Preheating improves the wetting of the coating to the substrate and contributes to the plastic flow of the coating material as it is applied during APS. A comparison of the surface quality between 100° C. preheat and 900° C. preheat revealed that surface roughness was decreased and coating porosity also decreased. Surface cracks appeared on the MORCO F14 material since the coating had a CTE almost twice that of the substrate. These cracks penetrated the substrate rather than following the coating/substrate interface. A strong coating bond strength is suggested by this crack behavior.

Crystallization can also be induced in the coatings by post thermal heat treatment. In this case, the powder feed to the plasma torch is turned off and the plasma plume is passed over the coating for an additional 30 seconds. The post thermal heat treatment does not appear to alter the surface coating quality.

The surface quality of the room temperature sprayed coating was adversely affected by pulsing of the powder feed during the coating process. Pulsing results when a large volume of powder is suddenly introduced into the plasma torch as a result of clogging and unclogging of the powder feed line. Modern APS systems will minimize this type of problem.

Plasma Spray Processing of Ceramics and Glasses

Plasma spray techniques can deposit refractory materials not possible with flame spray processes, because the extremely high temperatures (up to 5000° C.) achieved in a plasma allows the use of much higher melting temperature materials, including refractory metals (such as platinum and tungsten), oxide ceramics (such as alumina and zirconia), and high melting temperature glasses (such as the rare earth and magnesia-aluminosilicates).

Thermal spray is a process by which fine particles are introduced into a flame or plasma, melted (at least partially), accelerated toward a substrate, and, upon impact, formed into lamellae "splats" that mechanically adhere to surface irregularities on the substrate. The time elapsing between flattening of two particulates at the same location on a substrate has been estimated to be on the order of 1 ms while the time required to solidify a particulate is approximately 10 $\mu$s. High melting temperature materials, like ceramics, have particulates that flatten either on the substrate surface or on a particulate that has solidified previously. Therefore, the coatings are likely to mimic closely the substrate surface to which they are applied. Little flow is possible.

The size of the lamella that forms on the substrate surface can be estimated by:

$$D/d=1.29(v_p\rho_p/\eta_p)^{0.2}$$

where D/d is the relationship between the diameter of the lamellae (D) and the diameter of the initial particulate (d) and where $\rho_p$, $\eta_p$, and $v_p$ are the specific mass, viscosity, and velocity of the particulate upon impact. Although this relationship is likely too simplistic to predict the absolute size of the resulting lamellae, it provides insight into how the key parameters influence the lamellae size. For instance, if the particulate temperature prior to impact is close to or greater than the particulate melting temperature, $\eta_p$ is reduced significantly, resulting in a high D/d value indicating a large diameter splat. The same effect is predicted for increases in specific mass and particulate velocity.

The situation is far more complex when considering particulate temperatures that are non-uniform, which is the case with many ceramics. Their low thermal conductivities can result in large thermal gradients in the particulate prior to impact. The center of the particulate can be entirely unmelted which potentially can result in rebound of the center. To eliminate rebound, a large portion of the particulate must be molten just prior to impact. Careful control of the particulate melting temperature through addition of fluxing agents may be essential to formation of an appropriate coating.

Microstructural development of the sprayed coating can also be very complex, given that extremely rapid solidification (<10 $\mu$s) of the particulates can "freeze-in" metastable phases. Some of these phases are extremely difficult if not impossible to produce in any other manner.

Detailed microstructural characterization of thermal spray coatings is limited in the literature.

In the case of a zircon ($ZrSiO_4$) coating, Kuroda found that the predominant structure consisted of fine grains of tetragonal zirconia (~200 Å) dispersed evenly in a silica glass matrix. Zirconia particles larger than 0.1 $\mu$m were much less prevalent and were found to have a monoclinic crystal structure. Some zircon decomposed in the plasma stream and impacted the substrate as a mixture of zirconia and silica. The splats solidified too quickly for diffusion to have allowed the more stable zircon phase to re-form resulting in the larger monoclinic zirconia particles. The finer tetragonal zirconia-like phase separated and then crystallized from the zircon melt under the rapid cooling conditions.

With alumina-chromia coatings, the microstructure consisted of only an equiaxed, polycrystalline alumina-chromia solid solution. The observed structure was nearly identical to what would be expected for alumina-chromia materials indicating that the plasma had little effect on the resulting structure of the coating. Subtle changes in processing can result in pronounced differences in the phase development and the corresponding thermal, chemical and mechanical properties of the coating.

Kishitake attempted to quantify adhesion of alumina-chromia coatings on an alumina substrate and concluded that the adhesion could be improved significantly by heat treating the coated substrate whether an intermediate or bond coat was used. The heat treatment allowed diffusion of the coating into the substrate or intermediate coating and conversely diffusion of the substrate into the intermediate coating or the final coating. At that point the coating adhesion was no longer only mechanical in nature but was also chemical.

Two studies by Watson and McDonald showed that the mechanical properties of a thermal spray coating were controlled largely by residual stresses that develop during processing. Residual stresses arise from mechanical and thermal incompatibilities between the coating and the substrate. The most common cause of high residual stresses in a spray coating is a large thermal expansion mismatch between the substrate and the coating.

Yang showed that residual stresses could be eliminated or reduced to an acceptable level by using a transition coating or through the addition of a small amount of some lower melting temperature ceramic. With a transition coating, a three layer coating resulted in the best mechanical property development in configurations where a large thermal expansion mismatch existed. By using two intermediate layers having thermal expansions increasingly approaching that of the final coating, residual stresses were all but eliminated.

The low melting point ceramic additions, predominantly silica, result in formation of small amounts of glass in the surface coating. The presence of the glass helps to relax much of the residual stresses that would otherwise be present. Of course, if the material to be coated is a glass or will form a reasonably fluid glass in the plasma, other additions are unnecessary. A single layer coating typically will result in high residual stresses. Yang also noted that when a thin coating is applied little residual stress develops. The absence of residual stress probably results from limited contact between individual lamellae.

Matching the thermal expansion of the coating to the substrate would eliminate residual stress development. Selecting a coating with a thermal expansion that is slightly lower than the substrate will result in the best coating. The slight mismatch will place the coating in a state of compression that will actually make the coating slightly stronger and, therefore, more resistant to mechanical damage.

Okada showed that radio frequency (RF) plasma could also be used effectively to spray ceramic materials. An RF plasma has a larger volume and lower velocity than a DC plasma. It produces smaller thermal gradients. These advantages produce a more uniform coating while also allowing use of the higher melting point materials. An optimum coating can be achieved with starting powders having a nominal particle size from 80–100 $\mu$m, and possibly as large as 125 $\mu$m for high priority materials. For DC plasma spray, the particle size for an optimal coating was in the range of 50–60 $\mu$m. Larger starting powders allow increased deposition rates.

Compositional changes can occur during the plasma spray process, and these changes must be accounted for in preparing preferred starting materials. It is easier to modify the glass based starting materials than it is to modify the crystalline materials.

Cordierite has a unique crystal structure that yields a coefficient of thermal expansion on the order of $15\times10^{-7}/°$ C. Glass ceramics based on cordierite are often used where low thermal expansion materials are required, because they can be fabricated into complex geometries and then crystallized to yield the desired low thermal expansion.

Wang and Herman have reviewed the mechanical and electrical properties of plasma sprayed coatings of cordierite and other related compositions in amorphous and crystalline forms. They reported that thermal shock resistance of cordierite, forsterite, and spinel deposits was considerably higher than theory predicted. They attributed the increase in the thermal shock resistance to thermal stress relaxation resulting from a fine network of pores that formed in the coatings. Forsterite coatings did not spall off during thermal cycling experiments they nearly matched the thermal expansion of the steel substrate. The cordierite coating spalled during the same experiments because of a relatively large thermal expansion mismatch. The cordierite coatings failed by interlamellar fracture, suggesting that the coating-to-substrate bond strength was sufficient to withstand the stresses that developed during thermal cycling.

Zhang's research on alumina coatings indicated that the microstructures were characteristic of plasma spray coatings with high porosity, pronounced lamellae formation, fine grain size, and high residual stresses arising from processing. Coatings with much lower porosity and reduced lamellae formation could be produced using high substrate temperatures and low spray chamber pressures. Increased intersplat bond strength could be achieved by point spraying, as opposed to the more traditional multiple pass spraying technique. Elimination of cooling between spray passes also increased intersplat bond strength.

Kokini indicated that adding zirconia reduces the average coating surface temperature and prevents stress relaxation. This finding conflicts with previous reports that indicated that thinner coatings had reduced residual stress. Zirconia is a better high temperature insulator than alumina so the potential for significant stress relaxation exists in a thick coating where the exterior of the coating serves to insulate the bulk. Kokini determined that the most significant reduction in stresses results from decreasing the thermal expansion mismatch and reducing the modulus of elasticity of the coating.

Eaton and Berezin independently determined that the zirconia coating quality increased significantly as the silica content of the starting powder increased. Mendelson found that post laser glazing of zirconia plasma spray coatings formed dense, smooth surfaces with little or no cracking, resulting in a 60% increase in coating life.

Cordierite Glass-Ceramics

Cordierite ($2MgO\text{-}2Al_2O_3\text{-}5SiO_2$) or 2•2•5 MAS (magnesia-aluminosilicate) glass-ceramics possess desirable thermal and mechanical properties. Of the silicate or aluminosilicate glasses, only those with compositions near cordierite have the desired combination of a low thermal expansion coefficient ($15\times10^{-7}/°$ C.) coupled with a high mechanical strength (i.e., high durability) [flexural strength of 245 MPa and modulus of 150 GPa] in their crystalline form.

A major drawback to cordierite is the refractory nature of the components used to form the initial glass. Typically, $Mg(OH)_2$, $Al_2O_3$ and $SiO_2$ powders were weighed, mixed, and placed in a platinum crucible at 1650° C. for 5–6 hours until molten. The crucible was then removed from the furnace, and the glass was either quenched rapidly into water, or poured onto a heated platen and allowed to cool slowly. In both cases, the result was an amorphous glass that was annealed to allow crystallization.

Stoichiometric cordierite has a glass transition temperature near 834° C. and a crystallization temperature of 1080° C. A combined addition of 2 wt % $B_2O_3$, 2 wt % $P_2O_5$ and 2 wt % $TiO_2$ lowered the glass transition temperature to 770° C. and the crystallization temperature to 990° C. Addition of a small amount (<5 wt %) of $B_2O_3$ and $P_2O_5$ reduced the glass transition temperature to the range 780–830° C. and the crystallization temperature to a range of 930–1050° C., depending on the heating rate. Faster heating rates shifted the crystallization temperature to higher temperatures. Small additions of $Na_2O$ and $K_2O$ when combined with $B_2O_3$ and $P_2O_5$ lowered the glass transition temperature to 765° C. and lowered the crystallization temperature to 985° C. Additions of a more refractory-like oxide, such as 7 wt % $ZrO_2$, will lower the glass transition temperature to 815° C., but will raise the crystallization temperature to 1150° C. Additions of 7 wt % $TiO_2$ lowered the glass transition temperature to 760° C. and also lowered the crystallization temperature to 950° C. A glass transition temperature of 760° C. was also achieved by adding 10 wt % $CeO_2$, 7 wt % $ZrO_2$ and 7 wt % $TiO_2$, but the thermal expansion increased to $62.5\times10^{-7}$/° C., for time that of $15\times10^{-7}$/° C. for cordierite without any additives.

Crystalline cordierite powder can be made while avoiding high melting temperatures by combining magnesium nitrate, aluminum nitrate, fumed silica, urea and ammonium nitrate powders in a furnace at 500° C. The mixture undergoes an exothermic combustion reaction. The reaction product is collected and held at 1250° C. for 12 hours to obtain crystalline cordierite. This process takes too long to make it feasible to use to glaze ceramic dies. Therefore, $TiO_2$ was selected as a nucleating agent. $TiO_2$ added to cordierite enhances the crystallization without the formation of any crystalline $TiO_2$ or titanate phases.

After the cordierite glass precursor has been cast, it can then be crushed, milled, and plasma sprayed onto refractory concretes. Before, during, or after the plasma spraying, the precursor can be converted to the desired, crystalline cordierite glass-ceramic coating.

The first crystalline phase to form in cordierite from the amorphous glass is a silicon-rich phase (referred to a quartz solid solution or "stuffed" beta quartz) that forms around the nucleating agents or at a free surface. This quartz phase is quickly transformed to a hexagonal cordierite referred to as indialite. The remaining amorphous glass in the bulk of the particles then transforms to indialite, but more slowly than the initial surface crystallization. The indialite phase is metastable, and will finally transform to the stable orthorhombic cordierite, known as α-cordierite. This final solid state transformation involves the reordering of the Al/Si atoms in the stable α-cordierite structure.

Batches of cordierite glass were melted, both stoichiometric and with 8 mol % $TiO_2$. Some batches were quenched directly into water, and the resulting fritted glass was milled for plasma spraying. Other batches were poured into heated platens and allowed to quench more slowly. Some slow-quenched batches were ground and milled into glass powder, while other slow quenched batches were heat treated to crystallize the cordierite, then ground and milled. These powders were plasma sprayed onto the castable substrates. We analyzed the coating by electron microscopy to determine the adhesion and extent of crystallization. If the coating was not fully crystallized, post-processing heat treatments were investigated to produce the desired crystalline composition.

Fritted glass powder, prepared without the addition of $TiO_2$, was mixed with fine $TiO_2$ powder and plasma sprayed as a mixture. Solid particles dusted onto the surfaces of cordierite glass particles greatly enhance the crystallization, so the addition of the $TiO_2$ may accelerate the crystallization and eliminate the need for subsequent heat treatments of the coated surface.

TABLE 9

Phases present in low temperature heat treated samples as determined by XRD.

| Glass-ceramic composition | Glass (wt %) | $Quartz_{ss}$ (wt %) | Indialite (wt %) |
|---|---|---|---|
| 2·2·5 MAS + 0 mol % $TiO_2$ | 82.5 | 15.5 | 2.0 |
| 2·2·5 MAS + 2 mol % $TiO_2$ | 0* | 33.2 | 66.8 |
| 2·2·5 MAS + 4 mol % $TiO_2$ | 0* | 17.3 | 82.7 |
| 2·2·5 MAS + 8 mol % $TiO_2$ | 0* | 100 | 0 |

*assumed to be zero

A similar analysis was performed on the high temperature heat treated samples, and those results are presented in Table 10.

TABLE 10

Phases present in high temperature heat treated samples as determined by XRD.

| Glass-ceramic composition | Glass (wt %) | $Quartz_{ss}$ (wt %) | Indialite (wt %) |
|---|---|---|---|
| 2·2·5 MAS + 0 mol % $TiO_2$ | 0* | 7 | 93 |
| 2·2·5 MAS + 2 mol % $TiO_2$ | 0* | 4 | 96 |
| 2·2·5 MAS + 4 mol % $TiO_2$ | 0* | 9 | 91 |
| 2·2·5 MAS + 8 mol % $TiO_2$ | 0* | 0 | 100 |

*assumed to be zero

The high temperature phase in all cases was hexagonal indialite, not orthorhombic α-cordierite.

The lowest expansion occurs with titania additions between 2–4 mol %. With additions of 8–10 mol % $TiO_2$, the coefficient of thermal expansion becomes comparable with that of the amorphous glass. Thus, with appropriate addition of $TiO_2$ and heat treatment, this cordierite material can be produced to match the CTE of the candidate refractory materials on which it is sprayed.

We incorporate by reference the article: D. Weaver et al., "Development of Cordierite Coatings for Low Thermal Expansion Refractory Concretes," Thermal Spray: surface eng'g via applied res., ASM Int'l, Inc. 829–835 (May, 2000).

Details concerning the manufacture of ceramic SPF dies are provided in U.S. Pat. Nos. 5,638,724; 5,683,608; and 6,235,381, that we incorporate by reference.

CERADYNE also uses the trademark THERMOSIL in conjunction with the preferred concretes we use for making SPF dies. Suitable ceramics are drawn from the families of silicas (including quartz), aluminas, mullites, and mixtures thereof available from Ceradyne, Norton, or Pyromedia.

Only the cordierites containing 8.3 and 10.1 wt % $TiO_2$ produced crystalline coatings. At compositions less than 8 wt %, the crystallization appears to be controlled by surface nucleation at imperfections. With increasing preheat, the structure of the plasma sprayed coating does not promote surface crystallization, because, we believe, of improved surface wetting. Bulk nucleation controlled crystallization at compositions above 8 wt % $TiO_2$ and the presence of $Al_2TiO_5$ was detected in these compositions.

DTA and XRD analysis of the glasses in each region indicated that $TiO_2$ levels below 8.3 wt % promote the simultaneous formation of $quartz_{ss}$ and this is thought to be a result of the formation of $Al_2TiO_5$. Okada et al [7] suggested that $quartz_{ss}$ becomes less stable with decreasing $SiO_2$ content. Thus, formation of $Al_2TiO_5$ would yield a more silica-rich glass and therefore stabilize $quartz_{ss}$ structure.

Presence of $TiO_2$ compounds and mullite is expected to increase the thermal expansion of the cordierite glass ceramic. The coefficients of thermal expansion of rutile and mullite are approximately $90\times10^{-7}$/° C. and $68\times10^{-7}$/° C., respectively. A rule-of-mixtures type analysis clearly indicates that the appearance of these phases would significantly increase the CTE of the glass-ceramics. Because the glasses crystallized to the orthorhombic crystal structure contained the greatest volume fraction of higher expansion phases, these had the highest CTE of the glass-ceramics. With the addition of 6.5 wt % $TiO_2$ the activation energy increased significantly, likely because the crystal growth is impeded by a $TiO_2$ compound or excess $TiO_2$ at the crystallization front.

The preferred coating should have the same thermal expansion as the refractory concrete die (i.e. matched CTEs). Achieving matched CTEs limits the amount of $TiO_2$ that can be added to the cordierite and the possible processing of the coating. At $TiO_2$ contents below 8 wt %, the crystallization of the coating is controlled by surface nucleation. This requires lower preheats to maintain the inter-splat interfaces. At preheats above 700° C., the inter-splat interfaces disappear as the coating is applied and crystal nucleation is restricted to the surface and the bond line between the die and the coating. Crystallization produces a 2–4% volume contraction and will induce cracking upon transformation. At $TiO_2$ contents above 8 wt %, crystallization is volume nucleated. Under these conditions, extremely hard and dense crystalline coatings may be obtained by preheating the die to 700° C. prior to air plasma spraying.

EXAMPLE 1

Coating of Silica-based Refractory Concrete

In this example preheating controls the quality of the coating with crystallization performed in a post spray operation. Increasing the preheat temperature decreases the porosity in the coating; however, if the preheat exceeds 700° C. the coating will behave as a monolithic cordierite and will crack during crystallization. A lower preheat will maintain the inter-splat interfaces that act as heterogeneous nucleation sites, thereby producing lower transformation stresses in the coating. The optimum $TiO_2$ content would be between 5 and 6 weight percent. Finishing operations will be easier with lower preheat temperatures since the coating will be easier to abrade.

EXAMPLE 2

Coating of Mullite-based Refractory Concretes

When maximum strength and durability are required, an 8 wt % $TiO_2$ containing cordierite should be applied to a mullite-based concrete. A preheat of at least 700° C. will produce a crystalline coating during air plasma spray and the coating will have less than 4% porosity. Coating will require a finish polish using diamond-based abrasives.

While we have described preferred embodiments, those skilled in the art will readily recognize alternatives, variations, and modifications that might be made without departing from the inventive concept. Therefore, interpret the claims liberally with the support of the full range of equivalents known to those of ordinary skill based upon this description. The examples are given to illustrate the invention and not intended to limit it. Accordingly, limit the claims only as necessary in view of the pertinent prior art.

We claim:

1. A method for improving the life of a ceramic die made from a refractory concrete and subject to extended exposure to elevated temperatures in a metal forming operations the die having a forming surface, comprising the step of:

applying a glaze to the forming surface to harden the surface and to provide thermal shock resistance, the glaze having a coefficient of thermal expansion (CTE) substantially matching that coefficient of thermal expansion for the ceramic die achieved by adding 4–8 mol % of titanium oxide to the glaze and the glaze also having a high glass transformation temperature of at least about 800° C. suitable for the metal forming operation.

2. The method of claim 1 wherein the glaze is applied by plasma spraying.

3. The method of claim 2 wherein the die's forming surface is preheated.

4. The method of claim 1 wherein the glaze includes cordierite.

5. The method of claim 4 wherein the cordierite includes minor additions of $TiO_2$ to adjust the CTE.

6. The method of claim 4 wherein the glaze is crystalline.

7. A ceramic die having a forming surface coated with a toughening cordierite glaze at least on the die's forming surface to enhance the life of the die in SPF operations by hardening the die and providing thermal shock resistance, the cordierite glaze including titanium oxide for adjusting the coefficient of thermal expansion of the glaze to match that of the die, wherein the die is a refractory concrete, the glaze is 2-2-5 MAS cordierite glass, and the amount of titanium oxide in the glaze is 4–8 mol %.

8. A glazed ceramic die including a glaze on the forming surface made in accordance with claim 1.

9. The die of claim 8 wherein the glaze includes crystalline cordierite.

10. The method of claim 1 wherein the glaze includes 2-2-5 MAS cordierite glass with sufficient titanium oxide to essentially match the CTE of the glaze to the CTE of the die.

11. The glazed ceramic die of claim 7 wherein the glaze is applied by plasma spraying.

12. The glazed ceramic die of claim 7 wherein the glaze has a glass transition temperature of at least 800° C.

13. The glazed ceramic die of claim 11 wherein the glaze has a glass transition temperature of at least 800° C.

14. The glazed ceramic die of claim 7 wherein the die is silica based.

* * * * *